US006065931A

United States Patent [19]

Suenaga et al.

[11] Patent Number: 6,065,931

[45] Date of Patent: May 23, 2000

[54] GAS TURBINE MOVING BLADE

[75] Inventors: Kiyoshi Suenaga; Yoshikuni Kasai; Kazuo Uematsu, all of Hyogo-ken, Japan

[73] Assignee: Mitsubishi Heavy Industries, Ltd., Tokyo, Japan

[21] Appl. No.: 09/035,614

[22] Filed: Mar. 5, 1998

[51] Int. Cl.[7] ..... F01D 5/08

[52] U.S. Cl. ..... 416/97 R; 416/96 R; 415/115

[58] Field of Search ..... 415/114, 115; 416/96 R, 96 A, 97 R, 95

[56] References Cited

U.S. PATENT DOCUMENTS 5,382,135 1/1995 Green ..... 416/97 R
5,639,216 6/1997 McLaurin et al. ..... 416/95
5,795,130 8/1998 Suenaga et al. ..... 416/95
5,848,876 12/1998 Tomita ..... 416/97 R
5,915,923 6/1999 Tomita et al. ..... 416/97 R

*Primary Examiner*—Edward K. Look
*Assistant Examiner*—Richard Woo
*Attorney, Agent, or Firm*—John P. White; Cooper & Dunham LLP

[57] ABSTRACT

A gas turbine moving blade, which has a blade root section, a wing section, and a platform section, comprises a refrigerant supply port provided in the blade root section, a refrigerant recovery port provided in the blade root section, a serpentine passage provided in the wing section and communicating with the refrigerant supply port and the refrigerant recovery port, and a convection-cooling passage provided in the platform section and allowing sealing air and a refrigerant for cooling the platform section by convection to pass therein.

3 Claims, 3 Drawing Sheets

GAS TURBINE MOVING BLADE

BACKGROUND OF THE INVENTION

The present invention relates to a cooling technique for a gas turbine moving blade.

In a high-temperature gas turbine conventionally used in a combined plant or the like, cooling air at a relatively low temperature is run through passages in a blade to keep the blade temperature lower than that of a high-temperature gas, in order to protect the blade against heat from the gas. In this air-cooling system for the blade, the cooling air supplied from a blade root section is run through the cooling passages in the blade, and then discharged into the space (main turbine gas) outside the blade through holes in the outer edge of the blade.

Recently, a blade cooling system based on steam has been proposed as the alternative to the air-cooling system. According to this steam-cooling system, used cooling steam is recovered without being discharged, so that the thermal efficiency of the gas turbine can be expected to improve. In the combined plant, moreover, the recovered steam can be fed to a steam turbine to improve the efficiency of the whole plant.

In a moving blade of the gas turbine, the high-temperature gas directly influences its wing section and platform section. Therefore, these sections must be cooled entirely and uniformly. Usually, as a cooling passage for cooling these sections, a so-called serpentine passage may be provided in the moving blade in a manner such that its inner surface extends along the outer surface of the wing or platform section.

Since the wing section has a substantial thickness, in this case, the aforesaid serpentine passage can be relatively easily provided therein even if the wing section is formed by precision investment casting. In contrast with this, the platform section is so thin and wide that it is difficult and uneconomical to form the serpentine passage therein throughout the area by precision investment casting.

In order to increase the general efficiency of the combined plant, a pressure loss must be restrained in the process of cooling the gas turbine blade so that the recovered steam can be kept at the highest possible pressure as it is supplied to the steam turbine. If the cooling steam is run through the serpentine passage that extends throughout the interior of the platform section, however, the pressure loss becomes too high to ensure a substantial improvement of the efficiency.

BRIEF SUMMARY OF THE INVENTION

The object of the present invention is to provide a gas turbine moving blade designed so that the thermal efficiency of a gas turbine can be improved and the manufacturing cost of the blade can be reduced without lowering the cooling performance for a wing section and a platform section.

In order to achieve the above object, a gas turbine moving blade according to the present invention is designed so that a steam supply port and a steam recovery port are provided in a blade root section, a serpentine passage communicating with the steam supply and recovery ports is provided in a wing section, and a convection-cooling passage or film-cooling holes in which sealing air passes to subject the platform section to convection cooling or film-cooling are provided in the platform section.

In this arrangement, the wing section is cooled by steam, while the platform section is cooled by air. The air having cooled the platform section is discharged into a main turbine gas. Originally, however, this gas is sealing gas that is to be discharged into the main turbine gas. Thus, an extra cooling medium need not be discharged into the main turbine gas.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described in detail.

Figure 1:
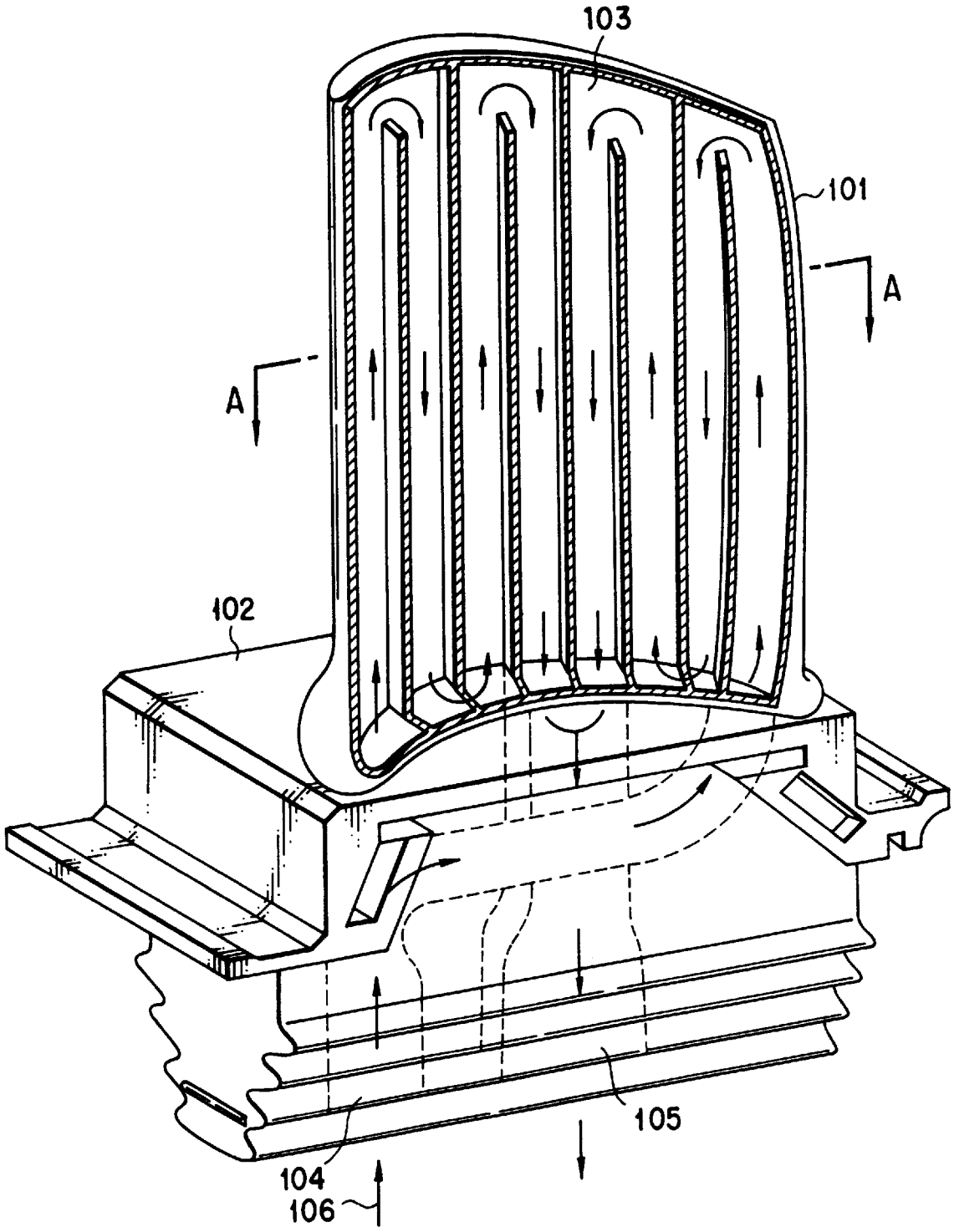
FIG. 1 is a vertical sectional view of a gas turbine moving blade according to an embodiment the present invention.

FIG. 1 is a vertical sectional view of a gas turbine moving blade according to the embodiment of the invention. Referring to FIG. 1, a wing section 101 has therein a serpentine passage 103, the inner surface of which extends along the outer surface of the wing section. A blade root section is provided with a steam supply port 104 and a steam recovery port 105. The serpentine passage 103 is divided between passages that are located on the leading and trailing edge sides of the blade.

Cooling steam supplied from the steam supply port 104 is divided in two directions by a forked passage in the blade root section. One portion of the steam is fed to the leading-edge-side passage of the serpentine passage 103, and the other portion to the trailing-edge-side passage.

In either passage, the cooling steam supplied through the steam supply port 104 advances meandering from the corresponding blade edge side toward the central portion of the blade, as indicated by the arrows in FIG. 1. The steam fed to the central portion of the blade advances to the steam recovery portion 105 through the passage in the blade root section, whereupon it is recovered.

Figure 2:
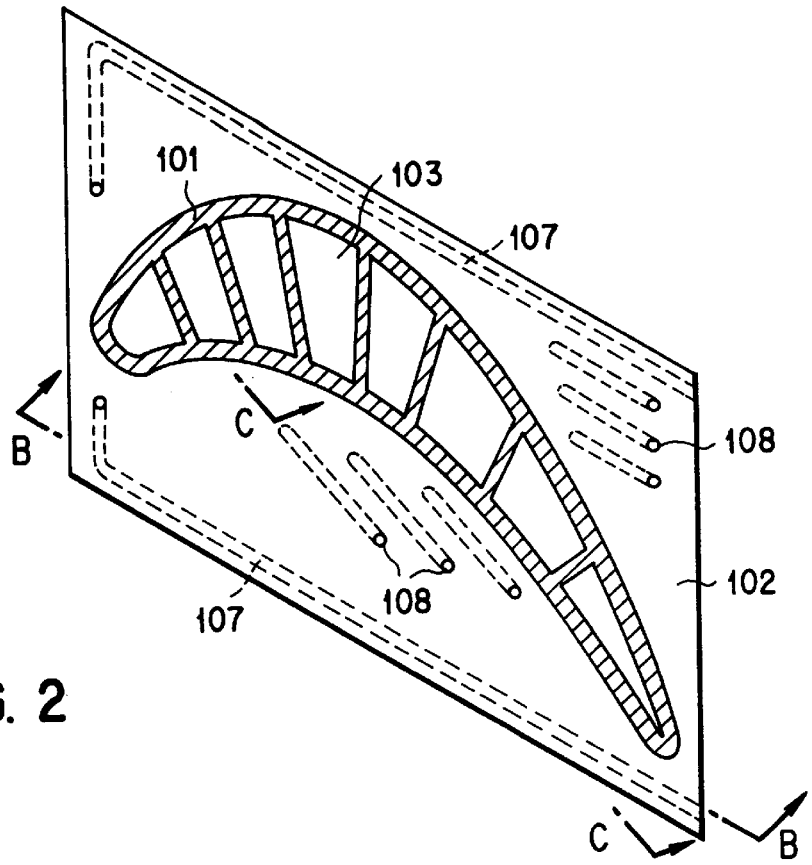
FIG. 2 is a sectional view taken along line A—A of FIG. 1.

FIG. 2 is a sectional view taken along line A—A of FIG. 1. In FIG. 2, a plurality of film-cooling holes 108 open in a platform section 102. The platform section 102 is film-cooled by means of cooling air ejected from the holes 108. The broken lines that extend toward the cooling holes 108 represent cooling air passages through which the cooling air is fed to the holes 108.

Figure 3:
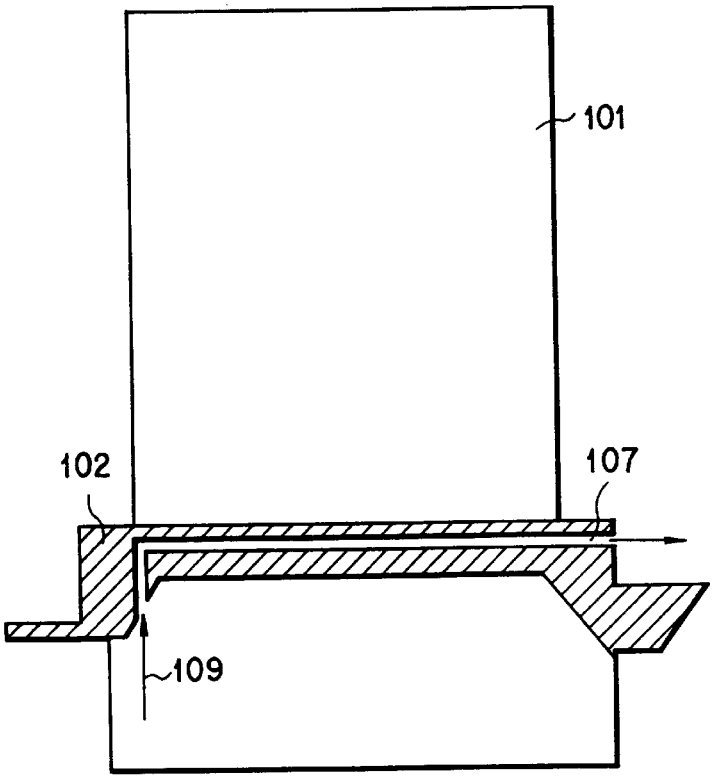
FIG. 3 is a sectional view taken along line B—B of FIG. 2.

FIG. 3 is a sectional view taken along line B—B of FIG. 2. In FIG. 3, the platform section 102 is provided with a convection-cooling passage 107 through which the cooling air 109 is run for convention cooling.

Figure 4:
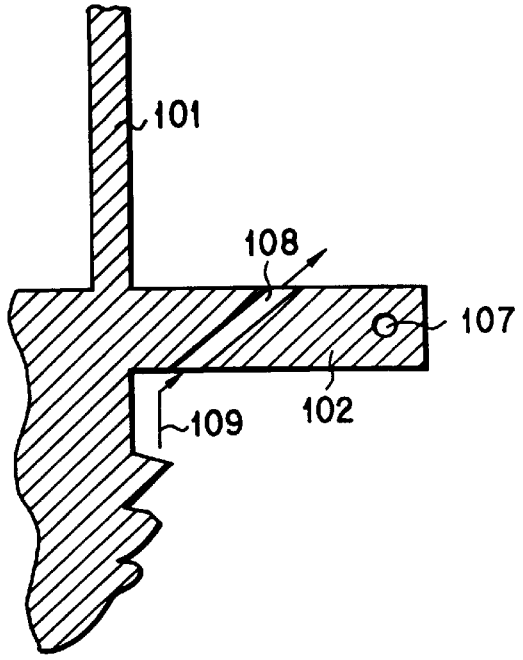
FIG. 4 is a sectional view taken along line C—C of FIG. 2.

FIG. 4 is a sectional view taken along line C—C of FIG. 2.

Figure 5:
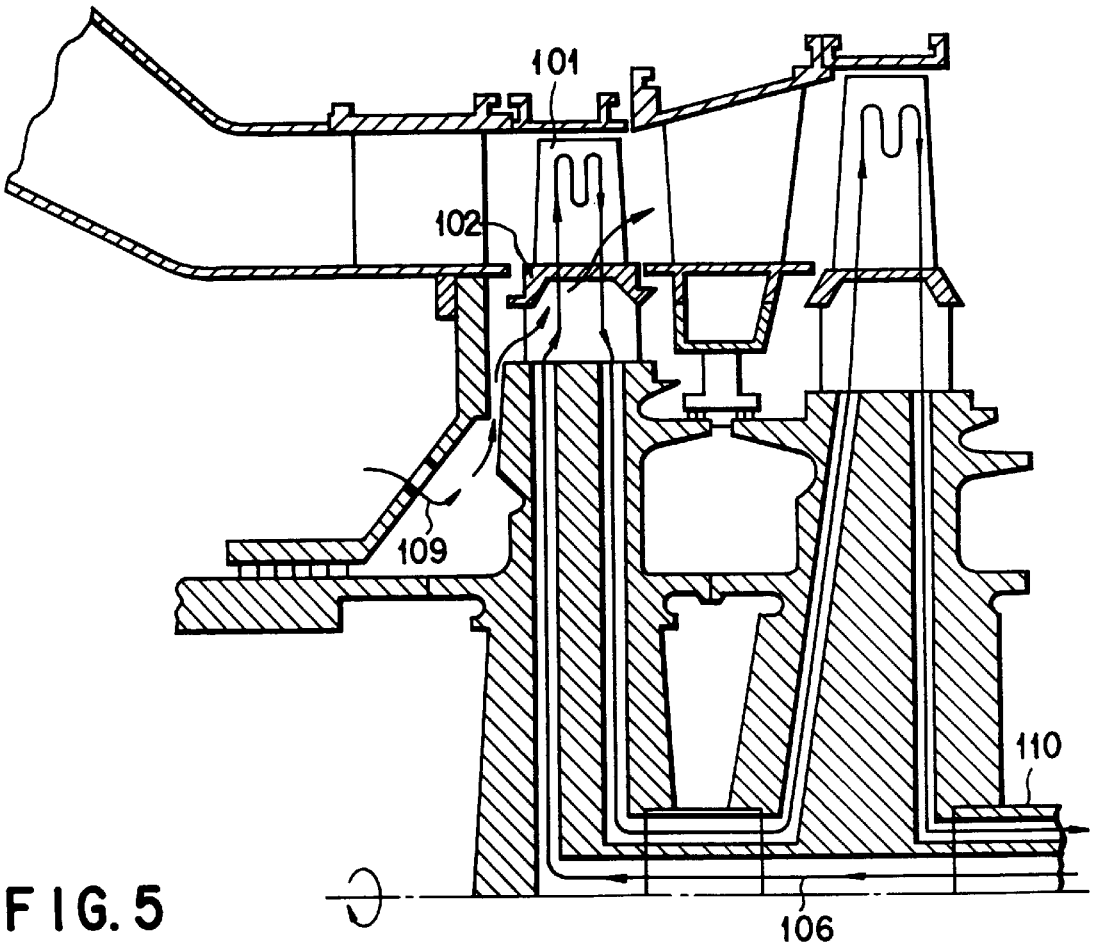
FIG. 5 is a sectional view of the internal structure of a gas turbine according to the embodiment, showing courses for the supply and recovery of cooling steam and cooling air.

FIG. 5 shows courses for the supply and recovery of the cooling steam and cooling air 109 according to the embodiment of the present invention. Referring to FIG. 5, cooling steam 106 is supplied to a first-stage moving blade via a turbine rotor 110. After cooling this blade, the steam passes through the rotor 110 and cools a second-stage moving blade. Thereafter, the steam is recovered via the rotor 110.

The platform section 102 is cooled by means of sealing air extracted from a compressor. Since there is a difference in pressure between the seal side and the main flow side, the sealing air flows out into a main turbine gas through the convection-cooling passage 107 and the film-cooling holes 108 in the platform section 102. Thus, the sealing air serves to cool the platform section 102.

According to the present invention, the thermal efficiency of the gas turbine can be improved and the manufacturing cost of the blade can be reduced without lowering the cooling performance for the wing section and the platform section. If the invention is applied to gas turbines in a combined plant, moreover, the efficiency of the whole plant can be increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A gas turbine moving blade a having a blade root section, a wing section, and a platform section, comprising:

a stream supply port provided in the blade root section;

a stream recovery port provided in the blade root section;

a serpentine passage, provided in the wing section, for communicating the stream supply port with the stream recovery port; and a convection-cooling passage which is provided in the platform section and in which sealing air passes to subject the platform section to convection cooling.

2. A gas turbine moving blade a having a blade root section, a wing section, and a platform section, comprising:

a stream supply port provided in the blade root section;

a stream recovery port provided in the blade root section;

a serpentine passages provided in the wing section, for communicating the stream supply port with the stream recovery port; and film-cooling holes which are provided in the platform section and in which sealing air passes to subject the platform section to film-cooling.

3. A gas turbine moving blade a having a blade root section, a wing section, and a platform section, comprising:

a stream supply port provided in the blade root section;

a stream recovery port provided in the blade root section;

a serpentine passage, provided in the wing section, for communicating the stream supply port with the stream recovery port;

a convection-cooling passage which is provided in the platform section and in which sealing air passes to subject the platform section to convection cooling; and film-cooling holes which are provided in the platform section and in which sealing air passes to subject the platform section to film-cooling.

* * * * *